US009577359B2

(12) United States Patent
Streckewald

(10) Patent No.: US 9,577,359 B2
(45) Date of Patent: Feb. 21, 2017

(54) PRINTED CIRCUIT BOARD CENTERING BEAM

(71) Applicant: FCI Americas Technology LLC, Carson City, NV (US)

(72) Inventor: Michael Streckewald, Etters, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 14/956,837

(22) Filed: Dec. 2, 2015

(65) Prior Publication Data

US 2016/0164206 A1 Jun. 9, 2016

Related U.S. Application Data

(60) Provisional application No. 62/087,906, filed on Dec. 5, 2014.

(51) Int. Cl.

| | |
|---|---|
| ***H01R 24/00*** | (2011.01) |
| ***H01R 12/72*** | (2011.01) |
| ***H01R 12/91*** | (2011.01) |
| *H01R 12/73* | (2011.01) |

(52) U.S. Cl.
CPC ..... *H01R 12/721* (2013.01); *H01R 12/91* (2013.01); *H01R 12/732* (2013.01)

(58) Field of Classification Search
CPC ..... H01R 13/64; H01R 13/514
USPC ..... 439/633, 637, 374
See application file for complete search history.

(56) References Cited

U.S. PATENT DOCUMENTS

| | | | | |
|---|---|---|---|---|
| 2,983,896 | A * | 5/1961 | Gilbert | H01R 13/645 439/633 |
| 3,614,714 | A | 10/1971 | Silverstein | 339/186 |
| 4,025,147 | A | 5/1977 | Van Arsdale et al. | 339/176 |
| 4,480,884 | A | 11/1984 | Babuka et al. | 339/17 |
| 4,869,672 | A | 9/1989 | Andrews, Jr. | 439/60 |
| 5,163,847 | A | 11/1992 | Regnier | 439/157 |
| 5,387,132 | A | 2/1995 | Sarver et al. | 439/633 |
| 5,785,556 | A | 7/1998 | Pratt et al. | 439/637 |
| 7,503,796 | B2 * | 3/2009 | Luettermann | H01R 13/631 439/377 |

* cited by examiner

*Primary Examiner* — Phuong Dinh

(74) *Attorney, Agent, or Firm* — Wolf, Greenfield & Sacks, P.C.

(57) ABSTRACT

A card edge connector including electrical contacts; and a housing having the electrical contacts connected thereto. The housing comprises a card edge receiving slot, and a beam extending at least partially across a width of the card edge receiving slot. An open space is provided between the beam and a bottom of the card edge receiving slot.

16 Claims, 5 Drawing Sheets

PRINTED CIRCUIT BOARD CENTERING BEAM

CROSS REFERENCE TO RELATED APPLICATION

This application claims priority under 35 USC 119(e) on U.S. Provisional Patent Application No. 62/087,906 filed Dec. 5, 2014, which is hereby incorporated by reference in its entirety.

BACKGROUND

Technical Field

The exemplary and non-limiting embodiments relate generally to a card edge connector and, more particularly, to an alignment feature in a card edge connector.

Brief Description of Prior Developments

Electrical card edge connectors are know which have a polarizing member in a card edge receiving slot.

SUMMARY

The following summary is merely intended to be exemplary. The summary is not intended to limit the scope of the claims.

In accordance with one aspect, an example embodiment is provided in a card edge connector comprising electrical contacts; and a housing having the electrical contacts connected thereto, where the housing comprises a card edge receiving slot, and a beam extending at least partially across a width of the card edge receiving slot, where an open space is provided between the beam and a bottom of the card edge receiving slot.

In accordance with another aspect, an example embodiment is provided in an assembly comprising a first electrical connector; a second electrical connector; and a riser printed circuit board connecting the first electrical connector to the second electrical connector. The first electrical connector comprises electrical contacts; and a housing having the electrical contacts connected thereto, where the housing comprises a card edge receiving slot, and a beam extending at least partially across a width of the card edge receiving slot, where an open space is provided between the beam and a bottom of the card edge receiving slot; and the riser printed circuit board having a card edge being configured to be located in the card edge receiving slot with an alignment slot at the beam, and a portion of the card edge located in the open space between the beam and a bottom of the card edge receiving slot.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
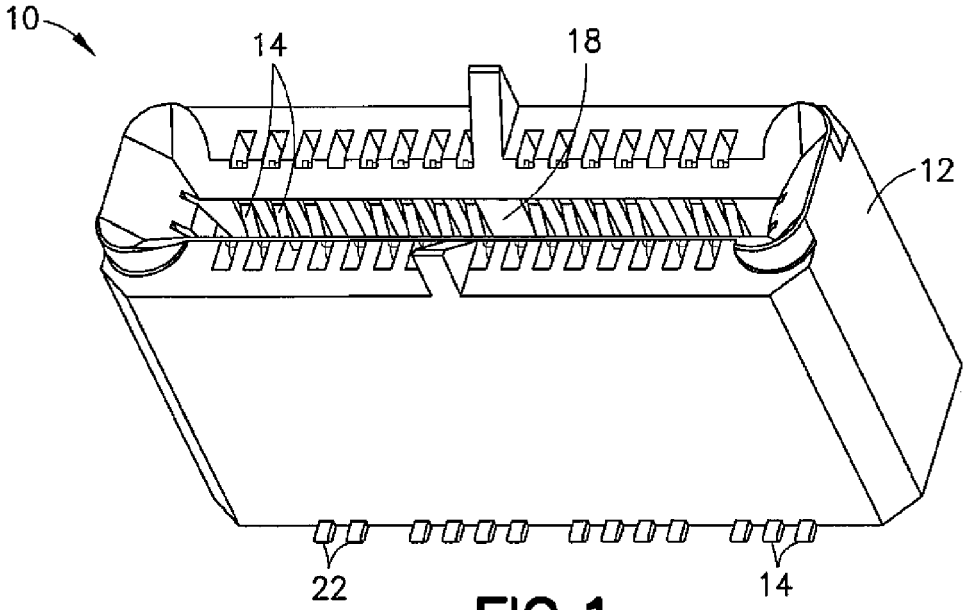
FIG. 1 is a perspective view of an example embodiment.

Referring to FIG. 1, there is shown a perspective view of an electrical connector 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

The connector 10 generally comprises a housing 12 and a plurality of electrical contacts 14. In this example embodiment the connector 10 is a card edge connector adapted to be mounted to a printed circuit board (not shown), such as a mother printed circuit board for example, and have a daughter printed circuit board (PCB) 16 (see FIGS. 5-7), such as a riser board for example, removably connected thereto.

Figure 2:
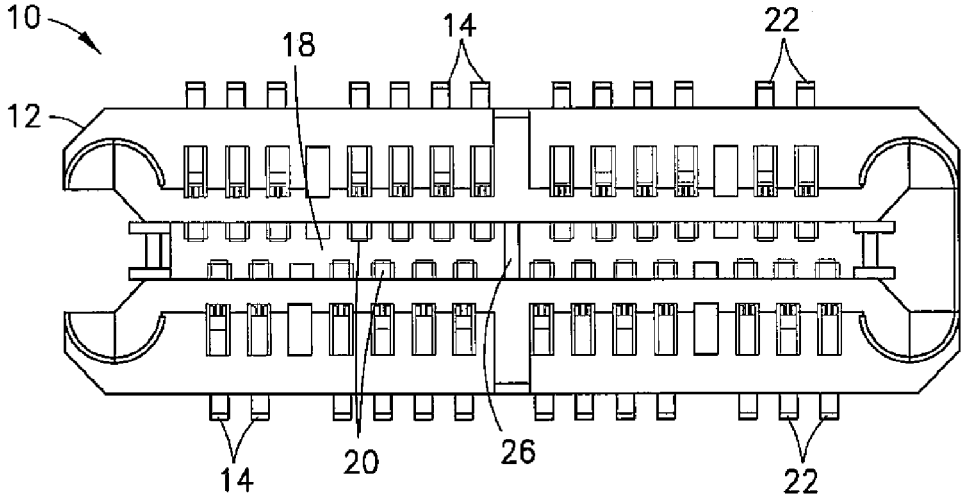
FIG. 2 is a top plan view of the example shown in FIG. 1.
Figure 3:
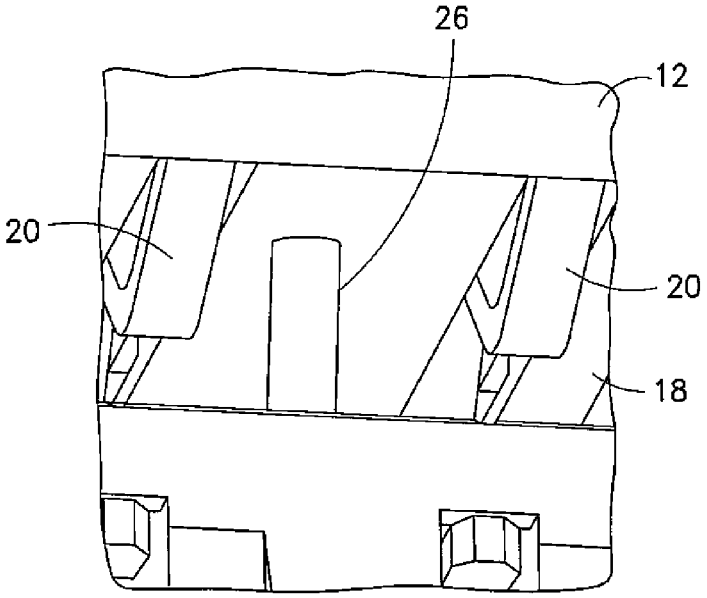
FIG. 3 is an enlarged, partial view of the example shown in FIGS. 1-2.
Figure 4:
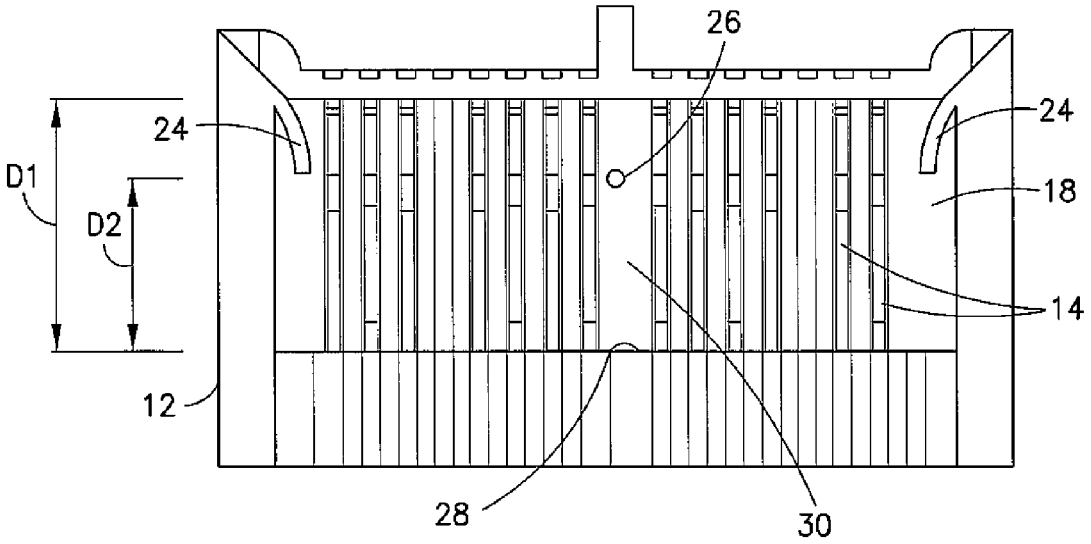
FIG. 4 is a schematic cross sectional view of the example shown in FIGS. 1-3.

Referring also to FIGS. 2-4, the housing 12 has a card edge receiving slot 18. The contacts 14 have spring contact areas 20 which extend into the slot 18 from opposite sides of the slot. Opposite ends of the contacts 14 have solder tails 22 which extend from the bottom of the housing 12. Please note that this is merely an example. Alternate examples may have spring contact areas on only one side of the card edge receiving slot and/or different types of contact tails. Although a vertical card edge connector is shown, features may also be used in a right angle card edge connector.

In this example the opposite lateral ends of the card edge receiving slot 18 have springs 24. The springs in this example are leaf springs which are integrally formed with the housing. However, in alternate example embodiments any suitable spring may be provided. Alternatively, no spring might be provided.

The housing 12 comprises a beam 26. In this example the beam 26 extends across the entire width of the card receiving slot 18 between the opposite sides of the slot 18. The beam 26 may be integrally formed with the housing as a one piece plastic member, or may be attached to the one piece plastic housing member after that member is molded for example. The beam 26 is located above the bottom 28 of the card edge receiving slot 18. Thus, an open space 30 is provided between the beam 26 and the bottom 28 of the slot 18. In other words, the beam has open space in at least four of its sides including its bottom side.

Figure 5:
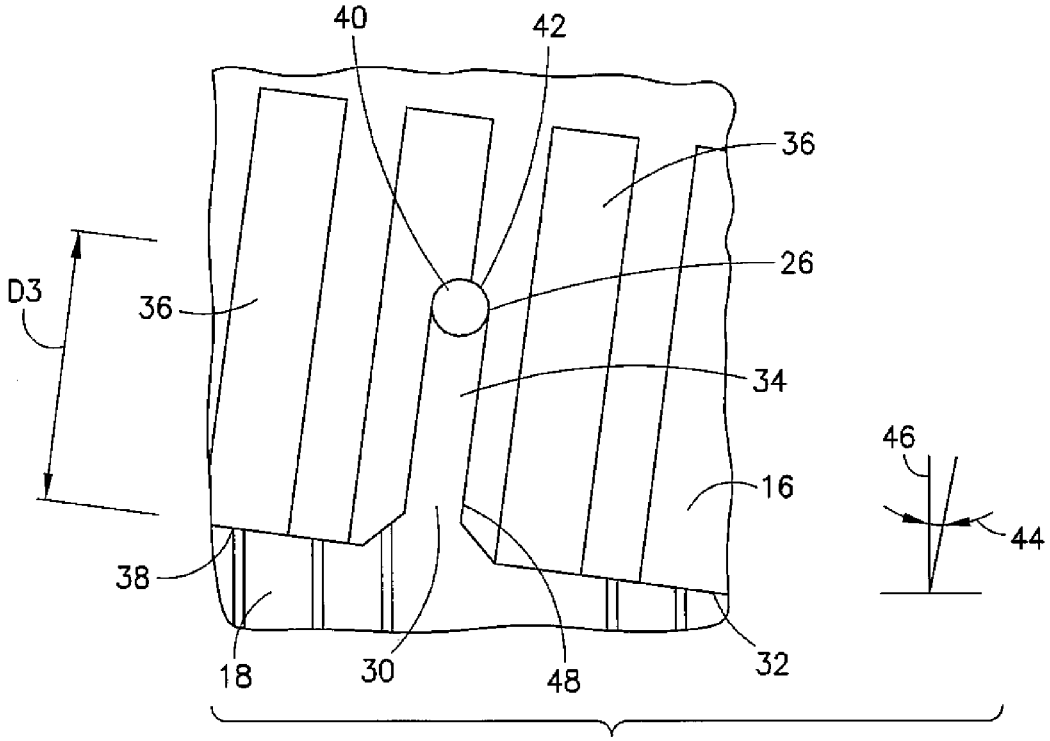
FIG. 5 is a diagram illustrating an example of misalignment.

Referring also to FIG. 5, a portion of a connection edge 32 of PCB 16 is shown in the card edge receiving slot 18. The PCB 16 is shown in an angled position in the slot 18 with an exaggeration to show the angle 44 as further described below. The PCB 16 has contact pads 36 configured to contact the spring contact areas 20 when the PCB 16 is inserted into the slot 18. The PCB 16 has an alignment slot 34 extending into its leading edge. The alignment slot 34 is configured to receive the beam 26. The slot 34 and beam 26 cooperate with the springs 24 to align the leading edge of the PCB in the slot 18 such that the spring contact areas 20 of the electrical contacts 14 align with the pads 36 of the PCB 16. The depth D1 (see FIG. 4) of the card receiving slot 18 and the height of the beam 26 in the slot 18 provides a distance D2 between the top 28 of the slot 18 and the bottom of the beam 26. The distance D2 is larger than the depth D3 of the alignment slot 34 from its leading edge 38.

Because of the difference in the distances D2 versus D3, when the PCB 16 is inserted into the slot 18, the end 40 of the alignment slot 34 contacts the top 42 of the beam 26. Thus, the leading edge 38 does not completely contact the bottom 28 of the slot 18. Most of the edge 38 (if not all of the edge 38) is prevented from contacting the bottom 28 because of the beam 26 contacting the end 40 of the alignment slot 34.

With this type of example embodiment the PCB 16, although substantially vertically inserted into the slot 18, may be canted as shown in FIG. 5 at an angle as illustrated by angle 44 versus the vertical axis 46 of the slot 18. The allowable angle 44 is limited by the size and shape of the housing to insure that the pads 36 still contact the contact areas 20, and do not contact more than one contact area 20. The open space 30 under the beam 26 allows part of the substrate of the PCB, adjacent the alignment slot 34, to move into the area 30 to allow the angling of the PCB 16. For example, as shown in FIG. 5, portion 48 can move into the area 30 between the bottom of the beam 26 and the bottom 28 of the slot 18.

Figure 7:
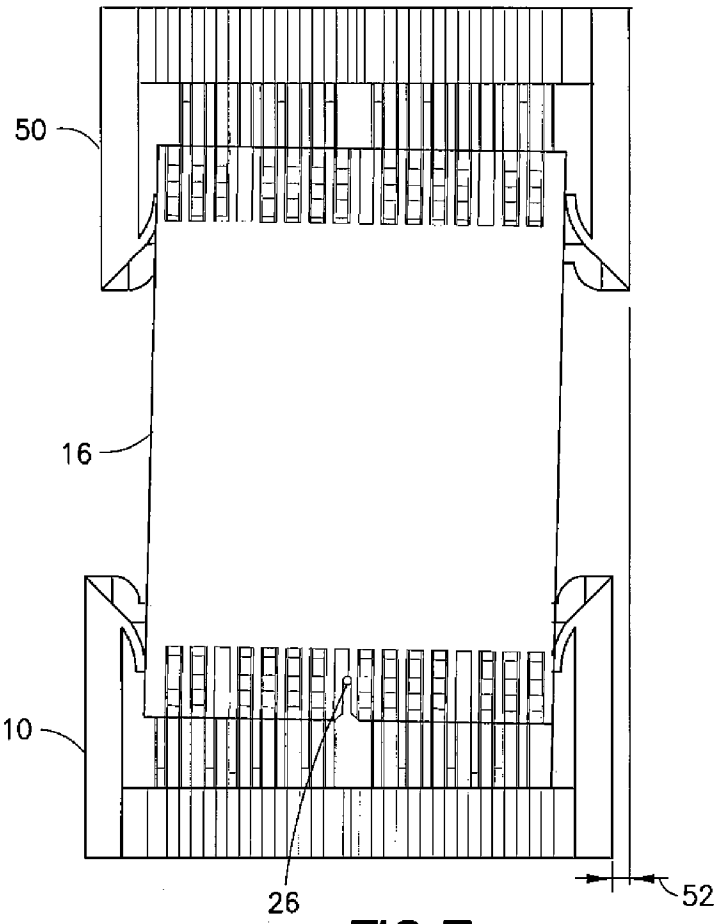
FIG. 7 is a cross sectional view illustrating connection of two electrical connectors by a riser board where the two connectors are misaligned.
Figure 6:
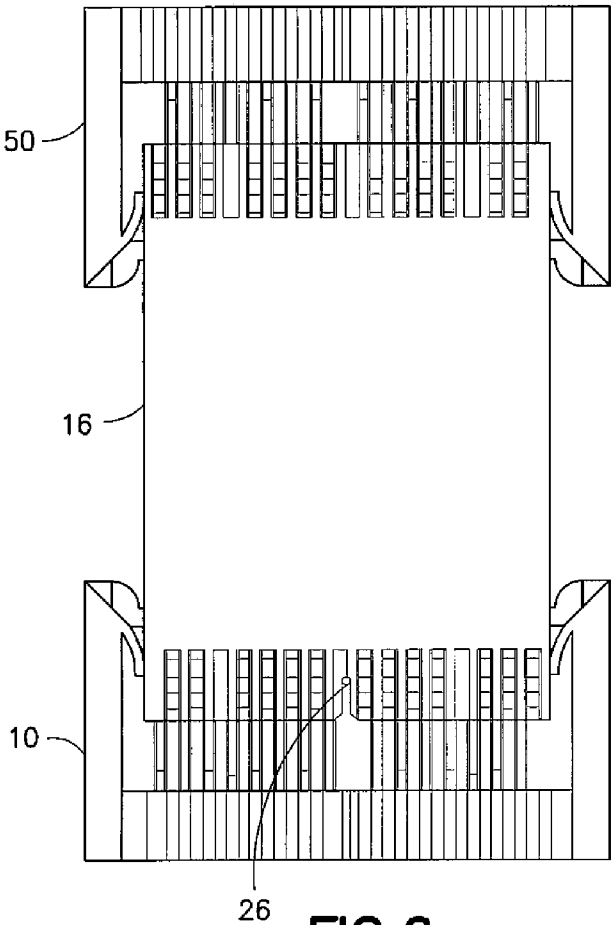
FIG. 6 is a cross sectional view illustrating connection of two electrical connectors by a riser board where the two connectors are aligned.

Referring also to FIGS. 6-7, FIG. 6 shows the PCB 16 being used to connect the connector 10 to a mating connector 50 as a riser board. The mating connector 50 is also a card edge connector and may be identical to the card edge connector 10. The mating connector 50 may be connected to another mother board, such as parallel to the first mother board or to an electronic module or component (not shown).

FIG. 6 shows the two connectors 10, 50 vertically aligned. In this example, the angle 44 would be zero (0). FIG. 7 shows the two connectors 10, 50 misaligned by a distance 52. In one example embodiment the distance of misalignment 52 may be 0.6 mm. However, this is merely an example. Thus, the angle 44 would not be zero. The system as described above allows PCB 16 to be angled relative to the vertical axis of the connector 10, but still insure that the contact pads 36 make proper electrical contact with their respective spring contact areas 20 of the electrical contacts 14. The system allows for misalignment 52 between the two connectors 10, 50 by allowing the PCB 16 to be controllably angled a limited amount.

The beam 26 may be located in the center of the slot 18; centered between the lateral end walls of the slot 18. The beam 26 may be offset from the center if polarization is desired. The beam 26 forms a pivot point for the end 40 of the alignment slot 34 on the beam 26. This may be a central pivot point when the beam is centered between the lateral end walls of the slot 18. The springs 24 can be considered weak springs to help assist with the riser board alignment. The riser board 16 can rotate about the centering beam 26 and, because of the centering beam's location, effects of misalignment 52 are greatly reduced. The mating connector variation is allowed for due to the weak springs 24 aligning the riser board and the centering pin 26 pinning the board on the base connector.

Features as described herein may be provided with a horizontal bar 16 that bridges the card receiving slot of a card edge connector. Unlike a conventional card keying projection positioned in a card receiving slot, which is open on only three sides (such that a PCB cannot rotate about the card keying projection), features as described herein provide a clearance space under the horizontal bar which permits a card to rotate about the horizontal bar. This provides some misalignment play, particularly if the card is mating to card edge connectors on both sides of the card.

Figure 8:
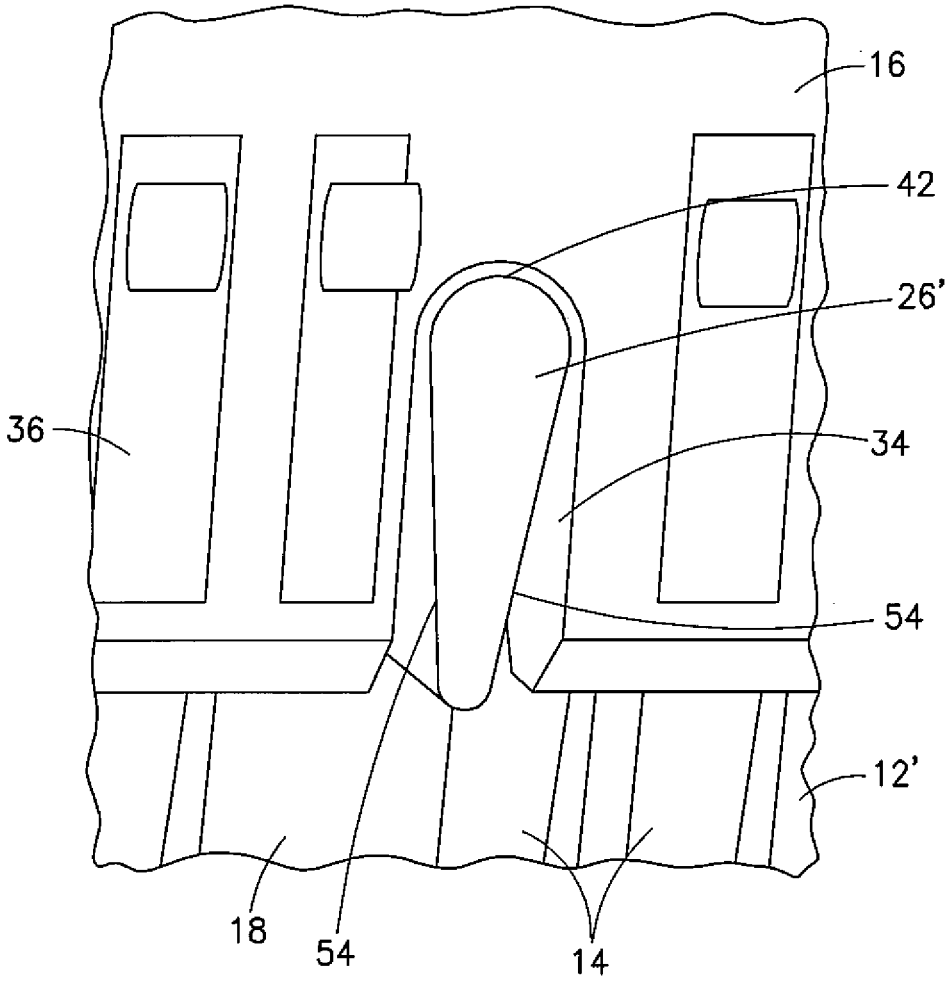
FIG. 8 is an enlarged, partial view similar to FIG. 5 illustrating an alternate example embodiment.

Referring also to FIG. 8, another example embodiment is shown. In this example the housing 12' has the same slot 18 and contacts 14 attached to the housing, but the beam 26' has a different shape versus the beam 26. The beam 26' has a general tear-drop shaped cross section. The tear-drop shape allows rocking of the board 16 on its top side 42 while providing more strength than a circular cross sectioned beam. The lateral side open areas 54 formed below the top of the tear-drop shape allow portions of the board 16 to move below portions of the top end of the beam 26'; thus allowing the board 16 to rotate or rock partially under the beam 26'. This example helps to illustrate that other alternate cross sectional shapes of the beam may be provided; not just a circular cross section.

An example embodiment may comprise a card edge connector comprising electrical contacts; and a housing having the electrical contacts connected thereto, where the housing comprises a card edge receiving slot, and a beam extending at least partially across a width of the card edge receiving slot, where an open space is provided between the beam and a bottom of the card edge receiving slot.

The beam may extend across an entire width of the card edge receiving slot, and where the open space includes an area completely under the beam. The beam may comprise a general tear-drop cross-sectional shape. A top surface of the beam may form a pivot surface configured to allow a printed circuit board to pivot thereon in the card edge receiving slot. Contact areas of the electrical contacts in the card receiving slot may be located at least partially above a top surface of the beam. A majority of each contact area of the electrical contacts in the card receiving slot may be located above a top surface of the beam. The housing may comprise at least one spring at a lateral end of the card receiving slot configured to push against a printed circuit board inserted into the card receiving slot.

An example embodiment may comprise an assembly comprising a first electrical connector; a second electrical connector; and a riser printed circuit board connecting the first electrical connector to the second electrical connector. The first electrical connector may comprise electrical contacts; and a housing having the electrical contacts connected thereto, where the housing comprises a card edge receiving slot, and a beam extending at least partially across a width of the card edge receiving slot, where an open space is provided between the beam and a bottom of the card edge receiving slot. The riser printed circuit board may have a card edge being configured to be located in the card edge receiving slot with an alignment slot at the beam, and a portion of the card edge located in the open space between the beam and a bottom of the card edge receiving slot.

The beam may extend across an entire width of the card edge receiving slot, and where the open space includes an area completely under the beam. The beam may comprise a general tear-drop cross-sectional shape. A top surface of the beam may form a pivot surface configured to allow the riser printed circuit board to pivot thereon in the card edge receiving slot. Contact areas of the electrical contacts in the card receiving slot may be located at least partially above a top surface of the beam. A majority of each contact area of the electrical contacts in the card receiving slot may be located above a top surface of the beam. The housing may comprise at least one spring at a lateral end of the card receiving slot configured to push against the riser printed circuit board in the card receiving slot.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. A card edge connector comprising:

electrical contacts; and a housing having the electrical contacts connected thereto, where the housing comprises a card edge receiving slot, and a beam extending at least partially across a width of the card edge receiving slot, where an open space is provided between the beam and a bottom of the card edge receiving slot, wherein contact areas of the electrical contacts in the card receiving slot are located at least partially above a top surface of the beam.

2. The card edge connector as in claim 1 where wherein the beam extend across an entire width of the card edge receiving slot, and where the open space includes an area completely under between the beam and a bottom of the card edge receiving slot the beam.

3. The card edge connector as in claim 1 where wherein the beam comprises a general tear-drop cross-sectional shape.

4. The card edge connector as in claim 1 where wherein a top surface of the beam forms a pivot surface configured to allow a printed circuit board to pivot thereon in the card edge receiving slot.

5. The card edge connector as in claim 1 where wherein a majority of each contact area of the electrical contacts in the card receiving slot are located above a top surface of the beam.

6. The card edge connector as in claim 1 where wherein the housing comprises at least one spring at a lateral end of the card receiving slot configured to push against a printed circuit board inserted into the card receiving slot.

7. An assembly comprising:

a card edge connector comprising:

electrical contacts; and a housing having the electrical contacts connected thereto, where the housing comprises a card edge receiving slot, and a beam extending at least partially across a width of the card edge receiving slot, where an open space is provided between the beam and a bottom of the card edge receiving slot, wherein contact areas of the electrical contacts in the card receiving slot are located at least partially above a top surface of the beam; and a printed circuit board inserted into the card edge receiving slot, where wherein:

the beam is located at a top end of a slot in the printed circuit board, and where the slot in the printed circuit board is sized such that a majority of a leading edge of the printed circuit board in the card edge receiving slot is prevented from contacting a bottom of the card edge receiving slot by the beam.

8. The assembly as in claim 7 where wherein a portion of the printed circuit board is located under between the beam and a bottom of the card edge receiving slot the beam.

9. The assembly as in claim 7 where the card edge connector is a first electrical connector, where wherein the apparatus further comprises a second electrical connector, and where the printed circuit board is a riser printed circuit board connecting the first electrical connector to the second electrical connector.

10. An assembly comprising:

a first electrical connector;

a second electrical connector; and a riser printed circuit board connecting the first electrical connector to the second electrical connector, the first electrical connector comprising:

electrical contacts; and a housing having the electrical contacts connected thereto, where the housing comprises a card edge receiving slot, and a beam extending at least partially across a width of the card edge receiving slot, where an open space is provided between the beam and a bottom of the card edge receiving slot; and the riser printed circuit board having a card edge being configured to be located in the card edge receiving slot with an alignment slot at the beam, and a portion of the card edge located in the open space between the beam and a bottom of the card edge receiving slot.

11. The assembly as in claim 10 where wherein the beam extends across an entire width of the card edge receiving slot, and where the open space includes an area completely under the beam between the beam and a bottom of the card edge receiving slot.

12. The assembly as in claim 10 where wherein the beam comprises a general tear-drop cross-sectional shape.

13. The assembly as in claim 10 where wherein a top surface of the beam forms a pivot surface configured to allow the riser printed circuit board to pivot thereon in the card edge receiving slot.

14. The assembly as in claim 10 where wherein contact areas of the electrical contacts in the card receiving slot are located at least partially above a top surface of the beam.

15. The assembly as in claim 10 where wherein a majority of each contact area of the electrical contacts in the card receiving slot are located above a top surface of the beam.

16. The assembly as in claim 10 where wherein the housing comprises at least one spring at a lateral end of the card receiving slot configured to push against the riser printed circuit board in the card receiving slot.

* * * * *